US007788733B1

(12) United States Patent
Zahner

(10) Patent No.: US 7,788,733 B1
(45) Date of Patent: Sep. 7, 2010

(54) TOWEL PRODUCTS

(75) Inventor: David Zahner, New York, NY (US)

(73) Assignee: Zahner Design Group, Ltd., New York, NY (US)

( * ) Notice: Subject to any disclaimer, the term of this patent is extended or adjusted under 35 U.S.C. 154(b) by 2417 days.

(21) Appl. No.: 10/062,588

(22) Filed: Jul. 5, 2001

Related U.S. Application Data

(63) Continuation of application No. 09/738,555, filed on Dec. 15, 2000, now abandoned.

(60) Provisional application No. 60/171,081, filed on Dec. 15, 1999.

(51) Int. Cl.
*A41D 13/08* (2006.01)

(52) U.S. Cl. ..... 2/16; 2/158; 211/113

(58) Field of Classification Search ..... 2/16, 2/20, 158, 160, 162, 170, 271, 161.6; 244/933; 248/315, 317, 686; 211/113, 118, 85.3; 383/22; 40/661.04, 673, 637, 586
See application file for complete search history.

(56) References Cited

U.S. PATENT DOCUMENTS

| | | | | | |
|---|---|---|---|---|---|
| 1,740,218 | A * | 12/1929 | Benjamin et al. | ..... | 2/162 |
| 3,146,464 | A * | 9/1964 | Burnett | ..... | 2/49.3 |
| 4,791,682 | A * | 12/1988 | Herr et al. | ..... | 2/160 |
| 5,134,746 | A * | 8/1992 | William | ..... | 15/227 |
| 5,590,972 | A | 1/1997 | Shobin | | |
| 6,494,248 | B1 * | 12/2002 | Zahner | ..... | 160/330 |
| 6,935,402 | B2 * | 8/2005 | Zahner | ..... | 160/330 |
| 7,058,988 | B1 * | 6/2006 | Zahner | ..... | 2/271 |
| 7,296,609 | B2 * | 11/2007 | Zahner | ..... | 160/330 |

* cited by examiner

*Primary Examiner*—Katherine Moran
(74) *Attorney, Agent, or Firm*—Pearl Cohen Zedek Latzer, LLP

(57) ABSTRACT

A supporting material such a loop fastener or a backing material integral with or attached to a towel or towel related product. The fastener allows the towel or towel related product to be attached to a rod, hook or so forth, without removing the rod from its supports, minimizing or eliminating the risk of the towel sliding off the rod and falling onto the floor.

18 Claims, 8 Drawing Sheets

235a
233
237
230

224a
224b
226
227
232a
232b
232c 207
206
200

216
217
214a
214b
210

190
20

20
190

187
180
182

187
180
182

246
242
240

244
246
240

254
252
258
250

264
262
265
266

170
175
177
172

170
175
172

20

20

6-10

344b
344a
350
340

402a
412
06
404
401
400
402b
408

375a
370
375b
160
380

TOWEL PRODUCTS

RELATED APPLICATIONS

The present application is a continuation of U.S. Nonprovisional application Ser. No. 09/738,555 filed Dec. 15, 2000 (now abandoned), which claims the priority of U.S. Provisional Application Ser. No. 60/171,081 filed Dec. 15, 1999, the latter application being fully incorporated herein by reference.

The present application is also a continuation-in-part of U.S. Nonprovisional application Ser. No. 09/738,545 filed Dec. 15, 2000 (now abandoned), which claims the priority of U.S. Provisional Application Ser. No. 60/171,081 filed Dec. 15, 1999.

The present application is also a continuation-in-part of U.S. Nonprovisional application Ser. No. 09/617,402 filed Jul. 17, 2000 (patented as U.S. Pat. No. 6,494,248), which claims the priority of U.S. Provisional Application Ser. No. 60/171,081 filed Dec. 15, 1999, U.S. Provisional Application Ser. No. 60/203,873 filed May 12, 2000, U.S. Provisional Application Ser. No. 60/143,853 filed Jul. 15, 1999, and U.S. Provisional Application Ser. No. 60/150,876, filed Aug. 26, 1999, all of which are fully incorporated herein by reference.

The present application also claims the priority of U.S. Provisional Application Ser. No. 60/217,747 filed Jul. 12, 2000, which is fully incorporated herein by reference.

The priority benefit of all of those prior applications is hereby claimed.

FIELD OF THE INVENTION

The present invention relates to methods and apparatus for hanging towels and related products.

BACKGROUND OF THE INVENTION

Previously, several devices and methods have been provided for hanging a towel. For example, U.S. Pat. No. 4,565,144 issued on Jan. 21, 1986 to Ricci ("the 144 patent") discloses a towel having a towel support provided therein. The towel support consists of an opening having a closed circumference with the opening being offset a distance from the edge of the towel. The circumference is referred to as "closed" herein in that the circumference is uninterrupted, with no break in it. The opening is also offset a distance from the edge of the towel such that towel material is provided between the towel edge and the slot end. As disclosed in the patent, this support is preferably a cut through the towel on the bias to the towel weave. This slot allows the towel to be suspended from a hook or nail without damaging the towel areas surrounding the slot.

Such a towel support can be used to suspend towels from hooks and nails; however, it is not suitable for use with the other household fixtures that are currently common in the art. In the present state of the art, most bathrooms are equipped with towel rods. The device of the '144 patent cannot be used to hang a towel from such rods.

As is well known, those towel rods are provided so that a consumer can fold a towel over the rod for easy access. Yet, at the same time, that method of draping towels also takes up an unduly large amount of space on a rod. It is also somewhat cumbersome or time consuming to fold the towel to place it on the rod, and furthermore, the folding of the towel over itself exposes less surface area of the towel to circulating air, thereby increasing the amount of time needed for the towel to dry.

Consumers also use other mounted bars to suspend towels therefrom. Such mounted bars include, but are not limited to, the rods on oven doors, the bars on refrigerators, and so forth. Thus, while the device of the '144 patent can be used with hooks and nails, it cannot be used with rods or the other numerous mounted bars currently common in the art. To use that device, the bars would have to be removed from their supports, which is impractical.

Unfortunately, the method of suspension most commonly used in the art, that of merely draping a towel over the rod, has other disadvantages as well. Any towel which is so draped is not particularly secure, but rather can fall off the rod onto the floor relatively easily. Since the purpose of the towel is for cleaning, that result is undesirable.

It is, therefore, an object of the present inventor to provide methods and devices which prevent towels from easily falling onto dirty floors.

SUMMARY OF THE INVENTION

It is an object of the present invention to provide apparatus and methods for securing towels onto mounted rods.

It is a further object of the present invention to provide methods and devices which prevent towels from easily falling from mounted rods onto dirty floors.

It is a further object of the present invention to provide apparatus and methods for securing towels onto mounted rods, without the need to remove the rod from its supports.

It is a further object of the present invention to provide integrated or attachable and detachable items for allowing the hanging of towels onto mounted rods.

It is a further object of the present invention to provide devices for allowing more towels to be hung off of a mounted rod than is currently conducted in the art.

It is a further object of the present invention to provide devices for drying towels hanging from a rod at a greater rate than is currently conducted in the art.

Further objects and advantages of the invention will become apparent in conjunction with the disclosure provided herein.

In accordance with the present invention, a variety of accessories and methods are provided for directly suspending towels from a mounted rod. In various embodiments of the invention, an opening is provided in the product (e.g. a slit), the opening communicating with an edge of the product and having both an open configuration and a closed configuration. The open configuration of the opening is one in which the opening is sufficiently large such that the product can be inserted onto the rod through the opening. The closed configuration is one in which the opening is reduced in size, or blocked or sealed, such that the product hangs off of the rod without falling. Preferably, the opening is a slit and a hole, with the slit extending from the hole to the edge of the towel.

In the preferred embodiments of the invention, a supporting material such a loop fastener or a backing material is integral with or attached to a towel or towel related product. The supporting material includes the opening therein and can be moved from the open to the closed configuration and back, allowing the product to be easily attached to and detached from a rod, hook, or so forth. This supporting material or fastener allows the towel or towel related product to be hung from the rod (or hook or other mounted support) without removing the rod from its supports, while minimizing or eliminating the risk of the product falling onto the floor.

In a preferred embodiment, the supporting material is an integrated loop fastener with an external slit extending through the loop, and if desired through the material of the towel related product, as well. The fastener can be of any desired shape and size and is attached at any location on the product, but preferably is close to or overlapping one of the product's edges. The fastener can be integral with the product or attached thereto as a separate unit, whether permanently or on a removable basis. Although one fastener per product is preferred, multiple fasteners can be utilized if necessary or desirable.

The inventions, therefore, allow any given towel to be easily and securely hung on either a rod, a hook, or numerous other common mounted supports. The inventions also reduce the amount of space needed to hang the towel on the rod or hooks, increasing the number of towels which can be hung on that rod or hook. In addition, they drape the towel open more fully, allowing the towel to dry more quickly than in the prior art method in which the towel is folded over itself while sitting on the rod.

Other objects and advantages of the invention will become apparent in conjunction with the disclosure provided herein.

BRIEF DESCRIPTION OF THE DRAWINGS

FIG. 3(*b*) is a perspective view of the embodiment of FIG. 3(*a*) being inserted onto a rod.

FIG. 10 is a side view of the embodiments of FIGS. 8 and 9.

FIG. 28 is a perspective view of a universal adapter in accordance with a further embodiment of the present invention.

FIG. 37 is a front view of a second embodiment of a rotating hook in accordance with the invention.

DETAILED DESCRIPTION OF THE INVENTIONS AND THE PREFERRED EMBODIMENTS

Figure 5:
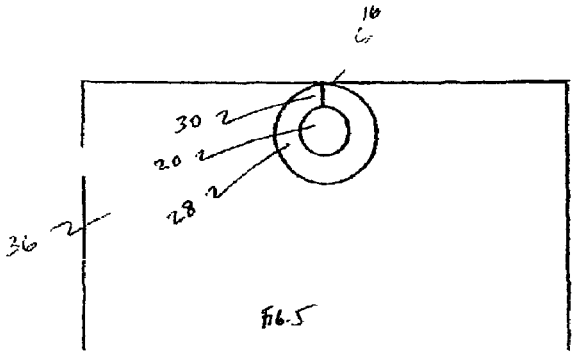
FIG. 5 is a front view of a further embodiment of a product of the present invention.

Currently in the art, towels are normally hung over a support such as a fixed rod, bar or so forth, by merely draping those towels over the rod or support. This method is common both indoors, such as in a bathroom or a kitchen, or outdoors, such as by a pool or on a fence. Those towels can easily be pulled off the rod by accident or can slide off of the rod, to fall onto a dirty floor.

In accordance with the present invention, methods and apparatus are provided for attaching towels onto supports to secure them onto the support. In the preferred embodiment, the support is a rod, e.g. such as a towel rod in a bathroom. Although the term "rod" is often used hereafter for simplicity as the preferred example of a support, it will be understood that the present invention can be used with any desired support, whether rods, bars, posts, sticks, shafts, protrusions, hooks, and so forth. The term particularly includes the towel rods, oven bars, refrigerator door bars, and so forth which are common in the art. Yet, as a further advantage, the present inventions can also be used to hang objects onto hooks. Furthermore, the inventions can be hung onto a variety of other items, such as door handles, door knobs, fences, exercise equipment, and so on.

All types of towels can be used with the present invention, including bath towels (e.g. wash cloths, large towels for use after showering), exercise towels, golf towels, sports towels, kitchen towels (e.g. dish towels and hang towels), car cleaning towels, and so forth. The invention can also be used with other products, such as towel-related products. The term "towel-related product" is intended to refer to towels and other related household products including, but not limited to, oven mitts, potholders, utensil holders, sponges for bathing, kitchen sponges, accessory holders, and so forth. It will be understood, therefore, that while the following discussion refers to towels, the embodiments of the invention can likewise be used with towel-related products, as well.

In various embodiments of the invention, any of the inventions described in U.S. Provisional Application Ser. No. 60/203,873 filed May 12, 2000 ("the '873 application"), U.S. Provisional Application Ser. No. 60/143,853 filed Jul. 15, 1999 ("the '853 application), U.S. Provisional Application Ser. No. 60/150,876, filed Aug. 26, 1999 ("the '876 application"), U.S. Provisional Application Ser. No. 60/171,081 filed Dec. 15, 1999 ("the '081 application"), U.S. Provisional Application Ser. No. 60/203,873 filed May 12, 2000 ("the 873 application"), the U.S. Provisional Application entitled "Suspended Bath Products and Clothing and Accessory Receptacles" filed by the present inventor on Jul. 12, 2000 ("the Suspended Bath Products Application"), and the U.S. Nonprovisional Application entitled Suspended Materials Having External Slits filed by the present inventor on Jul. 17, 2000 ("the External Slits application") can be used as part of the towels and towel-related products of the present invention. In addition, the inventions of U.S. Pat. No. 5,186,232, issued on Feb. 16, 1993 ("the '232 patent") can also be used as part of the towels and towel-related products of the present invention. All of those applications and the '232 patent are fully incorporated into the present application by reference.

In one embodiment, a '232 ring configuration is utilized. In the preferred embodiment, however, single rings with external slits are used as disclosed below. These latter embodiments take up less area of towel than a '232 ring configuration. In addition, since one fastener can be sufficient to hang a whole towel, these embodiments use less hooks for the towel and are, therefore, less expensive to manufacture.

Figure 1:
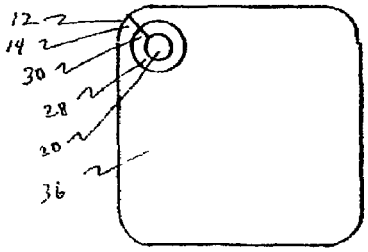
FIG. 1 is a front view of one embodiment of a product with a loop fastener in accordance with the present invention.

In one embodiment of the present invention, a towel or towel related product 36 includes an integrated loop fastener 28 which includes an slit 30. An example of such an embodiment is shown in FIG. 1. The integrated loop fastener or ring 28 with slit 30 can be positioned in any of various locations on the towel, the external slit 30 being located so as to intersect with an edge of the product 36 (preferably an upper edge, i.e. an edge which is on top when the item is held in the desired position for hanging), and communicate with the environment external to the towel. This allows the ring 28 to be attached over a rod 40, without removing the rod 40 from its supports.

Ring or fastener 28 can be in any desired position on or attached to the towel. In the embodiments shown in FIGS. 1 and 3(*a*), the ring is in the towel's corner. Alternatively, the ring may be in any other desired position, preferably near the towel's edge. For example, as shown in FIG. 4, the fastener can be located in the center of one of the product's edges.

Figure 2:
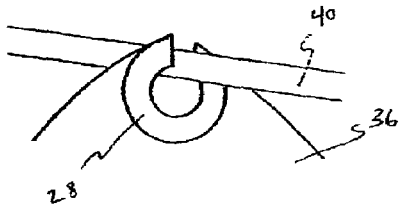
FIG. 2 is a perspective view of the embodiment of FIG. 1 being inserted onto a rod.

To attach the ring, the ring 28 is flexed slightly and inserted over the rod as shown in FIG. 2. This allows the towel and ring to be easily attached onto the rod whenever desired. The towel and ring can be easily removed from the rod by reversing the process. In this manner, the towel is securely yet removably attached to the rod. Even if the towel is pulled with moderate pressure it will not fall off of the rod and onto the ground.

Figure 4:
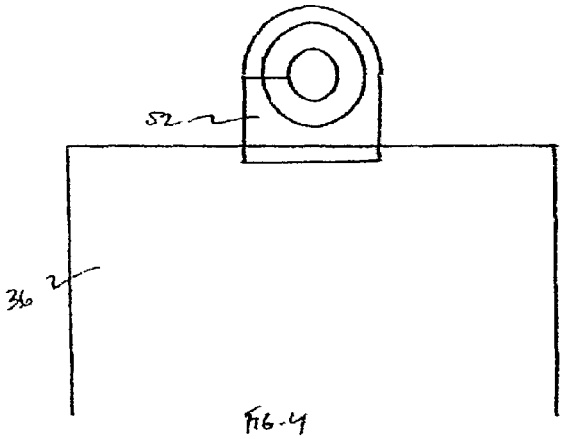
FIG. 4 is a front view of a further embodiment of a product of the present invention.
Figure 3B:
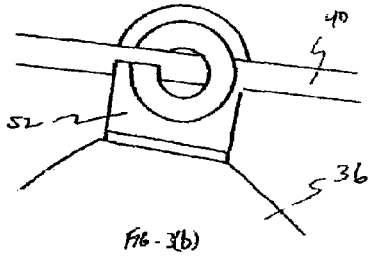
FIG. 3(*a*) is a front view of a second embodiment of a product of the present invention having a fastener located on a flap.
Figure 3A:
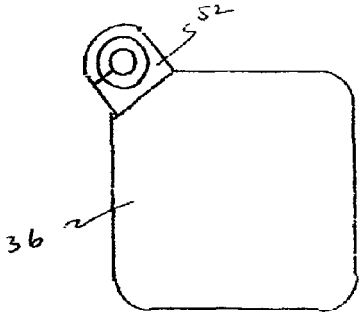

In a further embodiment of the invention, the integrated loop fastener 28 is attached to a flap 52 in the towel related product 36 as shown in FIGS. 3 and 4. As shown therein, towel or towel related product 36 is provided with a flap 52 that includes an integrated loop fastener 28 having an external slit 30. The flap 52 can be permanently affixed to the towel, e.g. by sewing, or by forming a towel in one integral piece with a flap extending therefrom. Or, the flap can be removably attached to the towel, e.g. by buttons, or velcro, or so forth. If desired, flap 52 can be folded over when the towel are folded for placement on a shelf.

As shown in FIGS. 1-4, the integrated loop fastener 28 can be located entirely with its circumference in the interior of the towel related product 36, and with the external slit extending from the towel related product to the edge 12 of the product 36. In those embodiments, the external slit 30 extends from the open interior or hole 20 of the integrated loop fastener, through the fastener, then through the material 14 of the towel related product 36, until the slit 30 exits at an edge 12 of the product.

In accordance with the invention, the product with the fastener can also be hung off of a hook, if desired, by inserting the open interior or hole 20 of the loop fastener over an end of the hook. Thus the product can be hung off a rod or a hook.

In alternate embodiments of the invention, the integrated loop fastener 28 can be placed so that an edge 16 of the fastener 28 touches the edge 12 of the towel related product 36 as shown in FIG. 5. In this alternate embodiment, the slit 30 extends from the open interior 20 of the fastener through the fastener to exit directly at the edge 12 of the towel related product 36.

Any of the configurations and embodiments of integrated loop fasteners or rings of the '232 patent and the applications cited above, or any of the construction techniques therein for making or manufacturing the rings, can be used in accordance with the present invention.

Thus, in accordance with the invention, an apparatus is provided which allows a towel ("a product") to be attached to a mounting rod or a hook. The apparatus consists of a supporting material integral with the towel, or attached or attachable to the towel, with the supporting material having an opening such as a slit provided therein. Preferably, the supporting material is in the form of a fastener or ring. In accordance with the invention, the slit can be of any shape or size desired, whether straight, curved, or so forth. Likewise it can be of any width desired, whether a uniform width, or a width which changes over the length of the slit, e.g. in an hourglass shape.

In the preferred embodiment, the supporting material has rigidity sufficient to support the towel on a rod or hook. Preferably, it also has sufficient elasticity or flexibility to allow the slit to be enlarged or flexed open until it is large enough to insert it over a rod. Further preferably, it has memory so that the ring will return to the original size of the slit when released, preventing the rod from falling through the slit. For example, the supporting material can be made of homo polypropylene, ABS, or other suitable materials. These materials are strong enough to support the various fabrics commonly used for the products of the invention. In addition, they also have excellent memory so that, after being flexed to fit over the rod, the ring automatically springs back to its original position. Thus, the ring can be bent or flexed when force is applied by the user, with the ring returning to its original position when the force is removed, and having sufficient rigidity and structural strength such that it can support the weight of the product when the ring is used to suspend the product on a rod.

As disclosed in the '232 patent, pairs of rings can be provided having a horizontal slit connecting each pair. In an alternate embodiment, the towel includes at least one external slit therein. By external slit, the present application refers to a slit which passes through the material of the towel (and through a ring as well if one is provided) to ultimately exit outside the towel.

Using an external slit, the external slit in the fastener and/or product can be at any orientation with respect to the plane or surface of the product. In one embodiment, an external slit can be used to hang the product at an approximately 90 degree angle to the bar, e.g. by providing a fastener with an external slit, wherein the fastener is located in or on the plane of the product or parallel thereto. Alternatively, an external slit can be used to hang the towel flat along the bar, by providing the fastener or external slit at an angle to the plane of the product. This is accomplished for example, by using an embodiment of fastener which attaches with a tab, or by using a rotating fastener. Alternatively, the fastener can be provided at any other angle to the plane of the product desired or necessary for a given use.

The external slit can also be in any angular orientation in the fastener and/or product, whether horizontal, vertical, or at any other angle. For example, when used in conjunction with a ring, the slit can extend through any position on the ring, whether the "12 o'clock" position, or to 1 o'clock, 2 o'clock, 10 o'clock, 11 o'clock, or so forth. Any combination of external slits, rings, and '232 configuration rings can be provided. For example, rings with external slits can be provided to the towel in addition to the horizontally slit rings of the '232 patent. Alternatively, the towel can be provided with externally slit rings only. Preferably, one ring with an external slit is provided to maximize the number of towels which can hang on a rod.

Figures 6, 7, 8, 9, 11, 12, 13, 14, 15, 16, 17, 18, 19, 20, 21, 22:
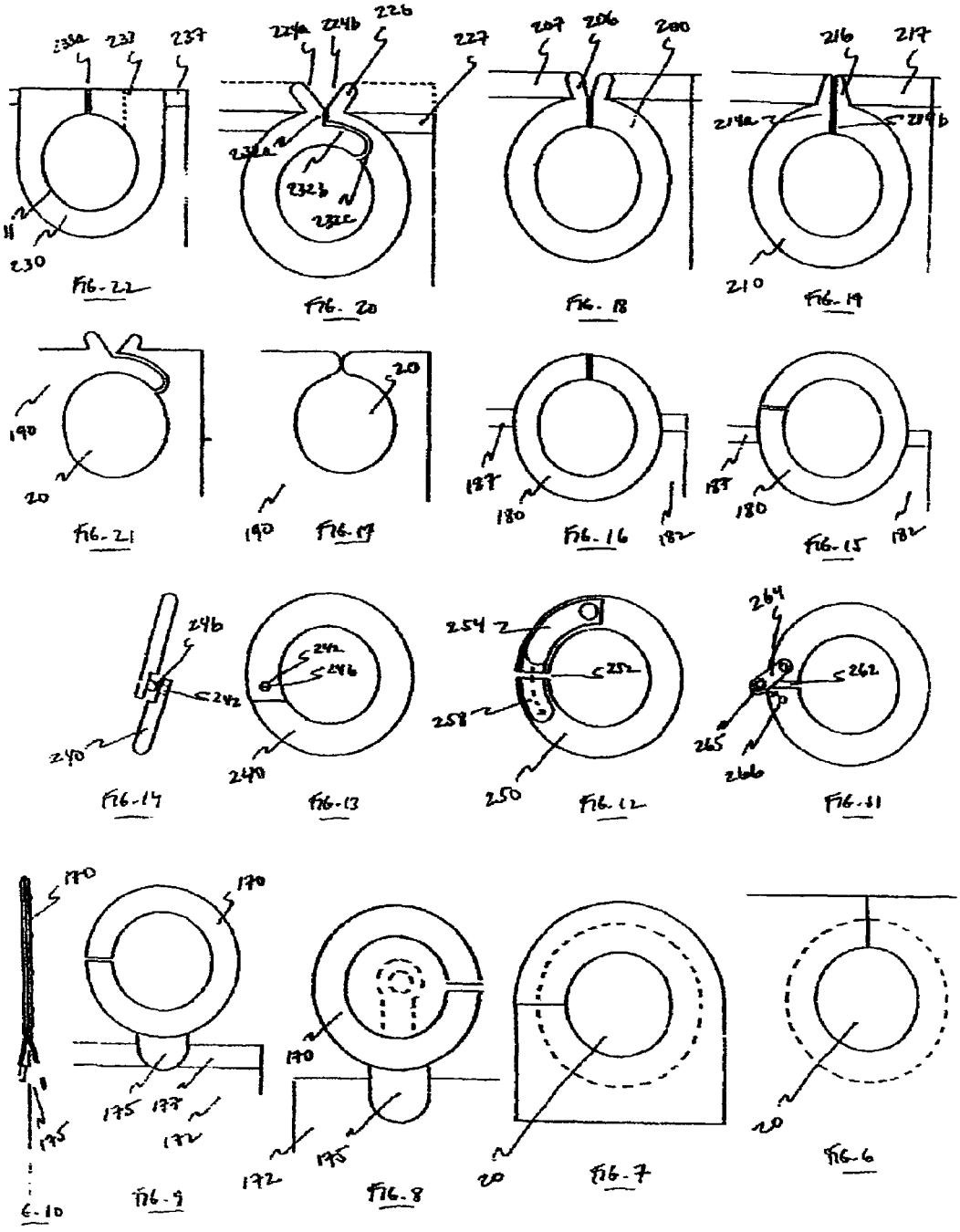
FIG. 6 is a front view of a loop fastener inserted into a product of the present invention.
FIG. 7 is a front view of a loop fastener inserted into a flap extending from a product of the present invention.
FIG. 8 is a front view of a loop fastener attached via a tab to a towel or towel-related product in accordance with the invention.
FIG. 9 is a front view of a integrated loop fastener inserted via a tab to a towel or towel-related product.
FIG. 11 is a front view of an embodiment of a loop fastener with a closure element for a product of the present invention.
FIG. 12 is a front view of a further embodiment of a loop fastener with a closure element for a product of the present invention.
FIG. 13 is a front view of a further embodiment of a loop fastener with a closure element for a product of the present invention.
FIG. 14 is a side view of the embodiment of FIG. 13.
FIG. 15 is a front view of a loop fastener with an offset horizontal slit attached to a product in accordance with the present invention.
FIG. 16 is a front view of a further embodiment of a loop fastener with a vertical slit attached to a towel or towel-related product in accordance with the present invention.
FIG. 17 is a front view of a product of the present invention in accordance with a further embodiment, with a rigid or semirigid insert or backing.
FIG. 18 is a front view of a product of the present invention having a loop fastener with a finger or extension extending therefrom.
FIG. 19 is a front view of a further embodiment of a product of the present invention having a loop fastener with a finger or extension extending therefrom.
FIG. 20 is a front view of yet a further embodiment of a product of the present invention having a loop fastener with a finger or extension extending therefrom.
FIG. 21 is a front view of a product of the present invention in accordance with a further embodiment having a rigid or semirigid insert or backing.
FIG. 22 is a front view of a further embodiment of a product of the present invention having a loop fastener attached thereto.

In one embodiment, as shown for example in FIG. 6, the ring is located within the area of the towel ("the hanging product") and the external slit extends from the ring and through the towel, exiting at the towel's edge. In other words, a space of exists between the ring and the edge of the towel, and the external slit extends through that space. The ring, as with the other rings or fasteners of the present invention, can be attached to the hanging product via any desired secure means. For example, the rings can be attached by staking, by sealing, by sewing, by welding, or by using any of the methods disclosed in U.S. Provisional Application Ser. No. 60/150,876, filed Aug. 26, 1999, whose contents are fully incorporated herein by reference.

In the embodiment shown in FIG. 6, a closed ring is provided. The term closed ring refers to the fact that the external slit is normally "closed"—i.e. the two radial edges which form the slit are pressed together. In this embodiment, the ring has some degree of flexibility, and must be flexed for the slit to open, i.e. for the edges of the slit to move some distance apart. Flexing the ring increases the width of the gap to insert the ring over the rod. The slit extends through the ring until the edge of the hanging product (whether that edge of the hanging product is beyond the edge of the ring or coincides with it as shown in various embodiments below).

Figure 23:
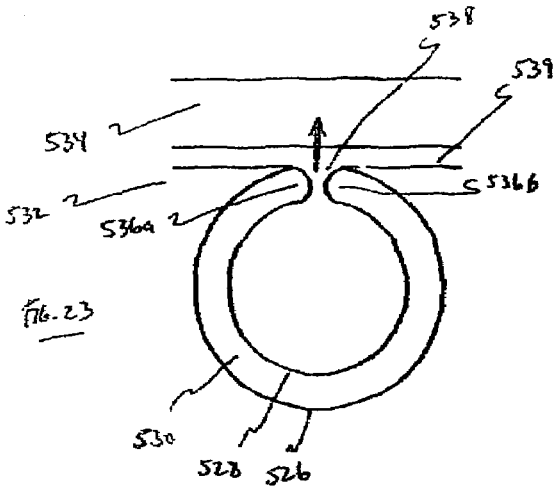
FIG. 23 is a front view of a further embodiment of a product of the present invention having an open loop fastener attached thereto as it is being inserted onto a rod.

In an alternate or additional embodiment of the invention, as shown in FIG. 23, an open ring 530 is provided in the material 532 of the towel for attachment of the towel to the rod or bar 534. In accordance with this embodiment, ring 30 is an open ring which is provided with rounded edges 536. A space is provided between the edges of the open ring, forming a mouth or gap 538 which acts as the external slit. Preferably, the gap is approximately 1/16" to 1/8" in diameter, although larger or smaller gaps can be used, depending on the application, rod size, and shape. Further preferably, the upper edge of ring 530 is tangent to the upper edge 539 of suspended material 532.

In this embodiment, rounded edges 536 and mouth 538 form an external slit design which is easy for a person to attach to rod 534. The difference between an open ring and a closed ring can be seen by contrasting the embodiment of FIG. 23 with the embodiment shown in FIG. 6. In the embodiment of FIG. 6, a closed ring is provided having a radial slit therethrough. The ring is closed in that the slit consists of a right radial edge and a left radial edge of the ring, those right and left radial edges being pressed against each other. In contrast, the embodiment of FIG. 23 provides an open ring structure in which a gap exists between the left radial edge 536*a* of the ring and the right radial edge 536*b* of the ring, radial edges 536*a* and 536*b* being the edges extending from the outer circumference or outer edge 526 to the inner circumference or inner edge 528 of the fastener or ring.

Furthermore, it is preferred that the radial edges of the open ring be rounded as shown in FIG. 23. Open mouth 538 and rounded edges 536 facilitate the attachment of the ring to the rod from below, and further facilitate the attachment of the ring with one hand. These features are of general advantage to all users, and are of particular advantage to individuals who may be short, to children, to the handicapped, and to those who might have trouble opening the ring due to problems such as arthritis.

The ring or fastener of the invention can be of any desired shape. For example, it can be rounded, oval (e.g. an ellipse which is elongated along the vertical or horizontal axis), or so forth. An elongated oval shaped rod can facilitate attachment of the ring to a square or rectangular rod. The ring 50 can include an open mouth (i.e. a gap between the slits), as in the embodiment of FIG. 23, or, alternatively, it can have a closed mouth, such as shown in FIG. 6. The ring can also have the edge of the ring tangent to the edge of the towel, as shown in FIG. 5. As an alternative to the use of an oval, which is preferred, the elongated ring can be any non-circular shape, including, for example, a rectangle or quadrilateral. Moreover, the external and/or internal edges of the ring need not be rounded although they are preferably so.

In one embodiment of the present invention, the ring wholly overlaps with the material of the towel, whether being a distance from the edge of the towel or touching the edge of the towel. The ring can be directly affixed onto the material of the towel. Or, it can be located within the towel, for example, inserted between two layers of material as shown in FIGS. 6 and 7. Likewise, for the embodiments in which the fastener is on a flap, the ring can also be affixed to the flap, or it can be located within the flap between layers of material, as shown in FIG. 7.

In alternate embodiments, as shown in FIGS. 15 and 16, ring 180 overlaps with the edge of the towel 182, such that ring extends beyond hem 187. The slit in the ring can be in any desired orientation, whether horizontal as in FIG. 15, or vertical as in FIG. 16.

In yet a further embodiment, a tab 175 can be placed at the bottom of a ring 170 (either horizontally slit as shown, or any other slit configuration of slit). Tab 175 is used to attach the ring to a towel 172 as shown for example in FIGS. 8-10. The tab can be secured to the hem 177 of the product, as shown in FIG. 9, or can be attached directly to the product as shown in FIG. 8. In one embodiment, one of the tabs folds down 180 degrees as shown in FIG. 8 (or both do), to ease attachment of the tab to the product. Alternatively, the tab can open to a lesser angle, such as the angle shown in FIG. 10.

The fasteners can have a horizontal slit as shown in FIGS. 8 and 9 or can have a vertical slit provided through the ring as shown in FIGS. 18 and 19. When a tab is provided, the tabs can be used to attach an integrated loop fastener to the top of a preexisting item though an existing hole in that item. For example, each tab could attach to a hole punched through the product during manufacture. Alternatively, the tabs could include a pointed pin to pierce a material which does not have existing holes. These embodiments, therefore, can be used to convert existing items into items having integrated loop fasteners. In a preferred embodiment, the tabs include an attachment pin and opening for that pin, with the pin being inserted into the opening as shown in FIG. 10.

When a tab is used, the plane of the fastener can be provided along or parallel to the plane of the surface of the product as shown in FIG. 8. Alternatively, the tab can be flush or parallel to the plane of the product, while the fastener is at an angle to the tab, whether 90 degrees or otherwise. This embodiment can be used to determine the angle that the product makes to the rod when it hangs along the rod, as further discussed below.

Any desired fabric material can be used for the product of the present invention. For example, the fabric material can be vinyl, cotton, polyester, polyester/cotton or any other natural or synthetic fabric, including woven or non-woven fabrics. Generally, the material is relatively soft.

In one embodiment of the invention, two half rings are placed together to encapsulate the fabric material therein. In an alternate embodiment, a single ring is integrated into the fabric material.

Figure 24:
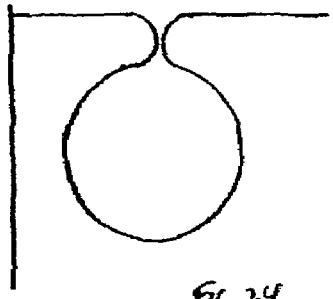
FIG. 24 is a front view of a product of the present invention in accordance with a further embodiment having a rigid or semirigid insert or backing.

Further embodiments are shown in FIGS. 17, 21 and 24. These embodiments can be cut directly into the material, e.g. with a backing of some supporting material 190 behind it, or can be inserted into the material (e.g. between two layers). In either case, the material of the embodiment is preferably relatively rigid or semi-rigid such as a thick vinyl. The external slit used can be a simple closed slit, as in FIG. 6. Alternatively, it can be a more rounded design such as shown in FIG. 17. An open slit (i.e. one with a gap between the left and right radial edges) with rounded edges can also be used, as in FIG. 24. Furthermore, the edges of the slit can be rounded in any of the embodiments of the invention, as shown for example in FIGS. 17, 21 and 24.

A projection, extension or finger can also be provided to the ring as shown in FIGS. 18-20. As illustrated in the figures, in further embodiments of the invention, a ring 200,210 or 220 is provided with a projecting edge, flange, extension, or finger 206, 216 or 226. Extensions 206, 216 or 226 are projections off of the ring (preferably off of the ring's outer circumference), which extend beyond the ring away from the hanging product (i.e. toward the ceiling). The extensions are each located adjacent to and to the side of the slit. Preferably two extensions are provided, one on each side of the slit.

These extensions serve numerous functions. For example, they make it easier to open up the slit when flexing the ring. Extension 206 or 216 of FIGS. 18 and 19, for example, are provided to overlap hems 207 and 217, respectively, supporting the hems of the towel and preventing it from drooping when the towel is hung on the rod. Fingers 206 and 216 also cover the cut vertical edge of the hem, preventing it from fraying. Finger 226, on the other hand, is provided beyond the hem 227, with the ring 220 overlapping the hem to support it. In this embodiment, a portion of the ring, the finger only, projects beyond the edge of the towel.

In a further additional design, the fingers can be spread and opposed as shown in FIGS. 18 and 20. As shown in FIG. 20, for example, fingers 226 can be provided as opposed "thumbs". In other words, inner edges 224*a* and 224*b* are at an angle to each other greater than 0 (zero) degrees but less than 180 degrees. This is in contrast to the inner edges 214*a* and 214*b* of the fingers of FIG. 19, which are parallel to each other. These spread fingers facilitate attachment of the rings 200 and 220 to a rod. They make it easier to slide the ring into the rod until the ring is pushed over the rod. They also make it easier to spread the ring open by hand to insert it over the rod. They can be used with a straight slit through the ring, or with a rounded or curved slit.

As an alternative to a straight external slit, a curved external slit 232 can be provided as shown in FIG. 20. In one embodiment, curved slit 232 has a first vertical component 232*a*, a second approximately horizontal component 232*b*, and a radial component 232*c*. Radial component 232*c* of slit 232 exits the inner circumference of the ring at a location which is offset to the side, rather than exiting the ring at the top of the inner circumference of ring 220 (i.e. rather than exiting directly below vertical component 232*a*). In this embodiment, fingers 224*a* and 224*b* are pulled to the left and right, respectively to open up the ring 220 and insert the ring over a rod. Curved slit 233, which intersects the inner circumference of the ring at an offset position rather than at the top of the ring, provides an advantage to the user in that the slit 233 will not sit directly on top of the rod while the towel is hanging or is in use. This eliminates the problem of the slit riding on the rod when the towel is pulled. Instead, a smooth surface of the ring rides on the rod, easing movement of the towel on the rod. The various features of the embodiment of FIG. 20 can also be provided directly to the towel without using a ring but by using a rigid or semirigid backing positioned on the towel (e.g. at a corner) as shown in FIG. 21.

In addition, the fingers or projections can extend past the hem as shown by the solid lines in FIG. 20. Alternatively, they can be located on the hem, as shown for example, by the dotted outline in FIG. 20, which shows the fingers extending up to the edge of the towel.

In a further embodiment, the ring 230 can be provided with a flat upper edge 235, as shown in FIG. 22. Upper edge 235 overlaps with hem 237. Upper edge 235, therefore, provides yet further support for the hem over an extended length of fabric. Using the embodiment of FIG. 21, upper edge 235 provides support over a length equal to approximately the outer diameter of the ring 230 for each ring. This upper edge can be the entire upper edge of the ring, and if desired can be used in conjunction with any of the extensions or fingers of FIGS. 18-20.

Instead of a vertical external slit 233*a* which is central, an offset slit 233*b* can be provided to any of the embodiments of the invention, as shown, for example, by the dotted line in FIG. 21. Offset slit 233*b* is a slit which intersects the inner circle 231 in a secant-like or tangent-like fashion. In other words, offset slit 233*b* is off center, such that the line it makes (if extended) would not intersect the center of inner circle 231. This offset slit allows the ring to glide more smoothly along the rod since the slit does not sit directly on top of the rod.

In further embodiments of the invention, a ring is provided which can be selectively opened or sealed, i.e. "locked" as shown in FIGS. 11-14. FIG. 13 is a front view of ring 240 and FIG. 14 is a side view of the ring 240 as it is being locked. Ring 240 includes a pin 246 which extends through a opening or channel 242. In the open position, shown in FIG. 14, the pin 246 is separated from channel 242, forming a gap for placing the ring on a rod. In the closed position, pin 246 inserts snugly into channel 242 to seal the ring.

Figures 25, 26, 27:
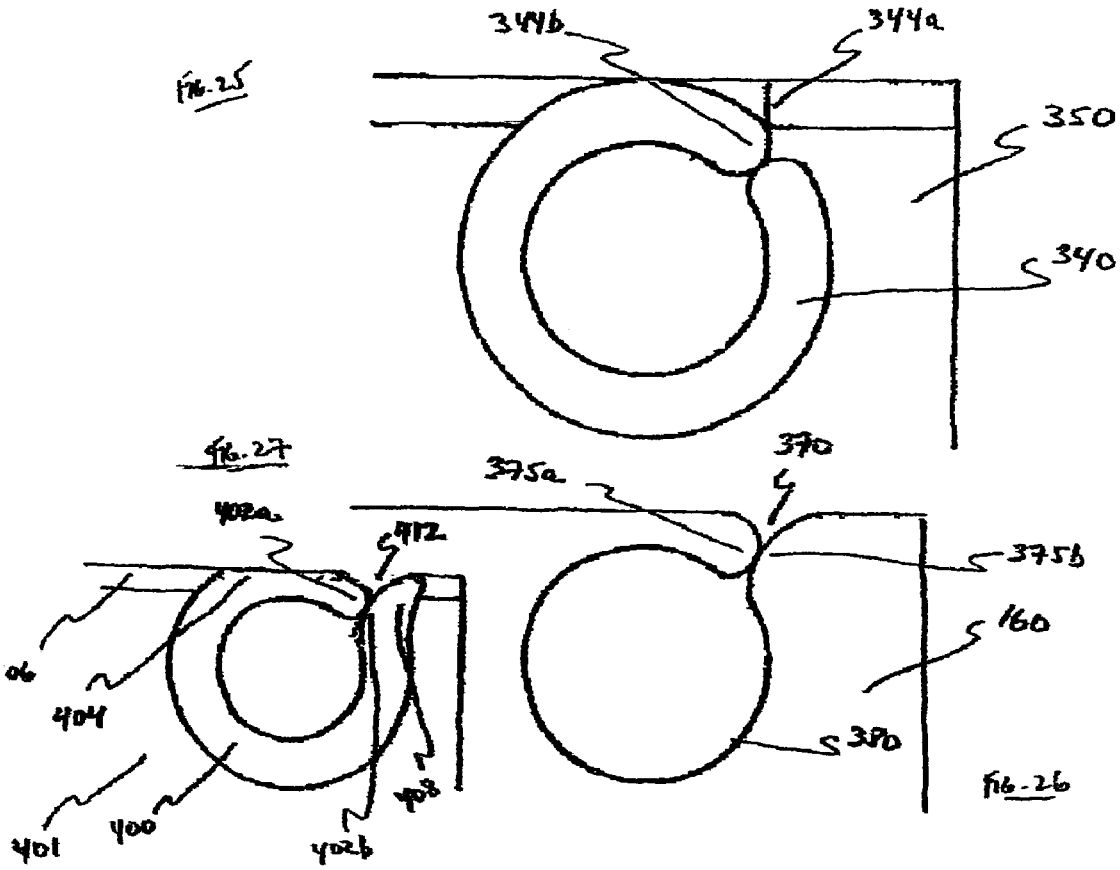
FIG. 25 is a front view of a further embodiment of a product of the present invention having a loop fastener attached thereto, wherein the slit through the product is at an angle to the slit or opening through the fastener.
FIG. 26 is a front view of a product of the present invention in accordance with a further embodiment having a rigid or semirigid insert or backing.
FIG. 27 is a front view of a loop fastener attached to a product of the present invention.
Figure 2B:
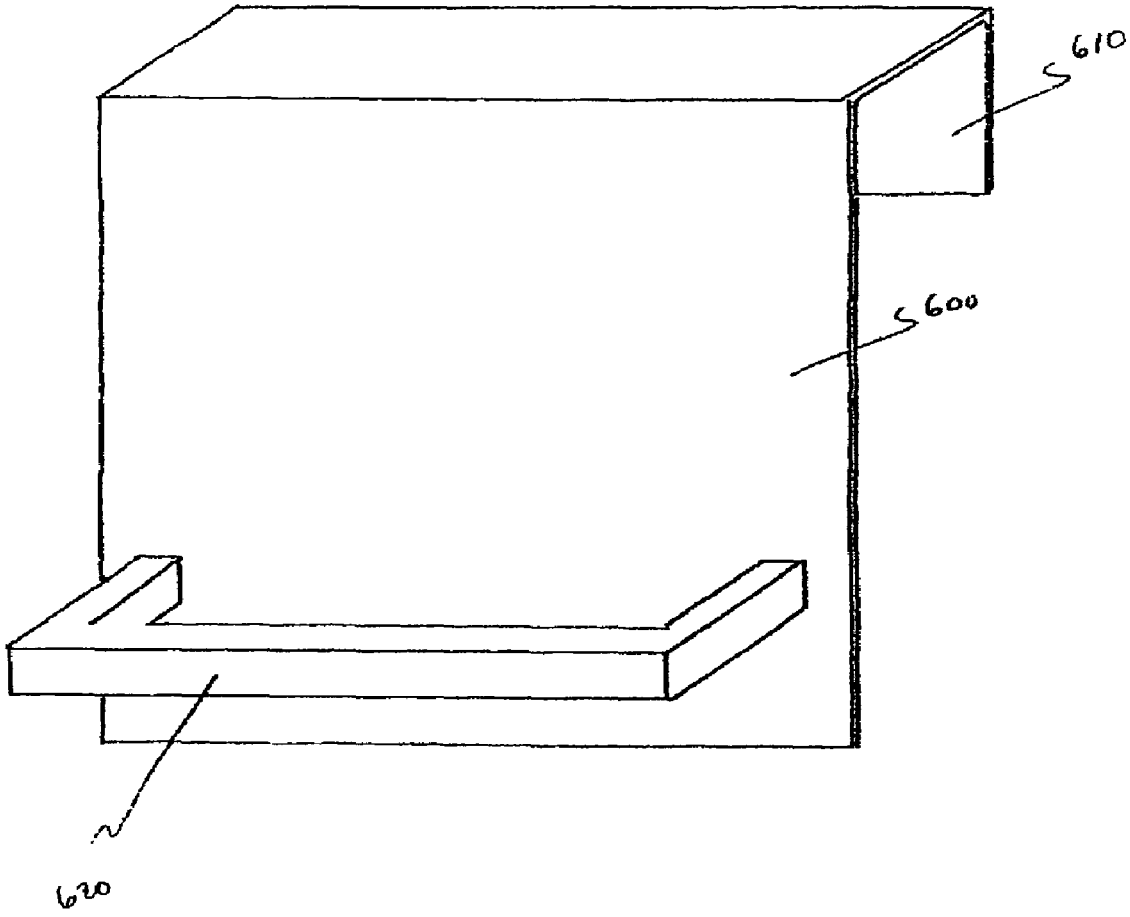

In further embodiments of the invention, a ring 250 is provided, as shown in FIG. 26. Ring 250 includes an internal sliding member 254 which can be pushed or pulled using knob 256. Sliding member 254 slides into and out of internal channel 258 to close and open gap 252. In an alternative embodiment, shown in FIG. 11, a pivoting member 264 is provided, having a pin 265 which inserts into an opening 266. Pivoting member 264 can be rotated to open or close gap 262. Alternatively, the gap can be dosed by straps which utilize snaps, velcro or other attachment devices.

In general, the embodiments of FIGS. 11-13 are useful for providing a very secure ring which cannot accidentally be pulled off of a rod. They also increase the smoothness of the sliding of the rings along the rod. If desired, they can be made with rigid or semi-rigid materials for the fastener. Or, they can be made with soft materials. For example a soft fastener can be used for the embodiment of FIG. 11, with a strap being provided in place of the pivoting member 264, wherein the strap secured to a mating element 265.

In a further embodiment of the invention, a tape or strip may be provided having any of the embodiments of the rings shown herein. Such a strip can be used to convert an existing towel into one of the present invention, or can be used to provide a hanging product in which the specific types of fasteners provided on top can be interchanged. The strip includes attachment devices which attach to the top of the towel.

For example, in one embodiment, a blank or template of material can be provided which has a cutout of material shaped like a pair of rings, each pair being connected by a strip of material including a horizontal slit as in the '232 patent. This blank or template can then be attached to a preexisting item, e.g. using tabs on the bottom blank as previously discussed with respect to the rings of FIGS. 8-10, or using adhesive, or any other desired attachment means.

Likewise, in an alternate embodiment, a tape can be used, wherein the tape has fasteners therein. The tape is a strip of material which includes a pattern of any embodiment or combination of embodiments of the loop disclosed above. The tape further includes an attachment element for attaching the tape to a desired material. In one embodiment, the attachment element is a tab. In other embodiments, the attachment element is adhesive, or so forth.

Figure 29:
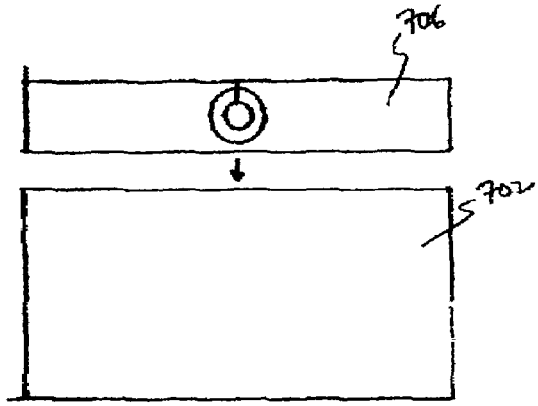
FIG. 29 is a front view of a strip having a loop fastener therein, for attachment to a product in accordance with the present invention.

An example of such embodiments of the invention is shown in FIG. 29. Strip 706 can be used to convert an existing towel or towel-related product 702 into one of the present invention, or can be used to provide a towel related product in which the specific types of fasteners or provided on top can be interchanged. Strip 706 includes attachment devices on the bottom of the strip which attach to the top of the hanging product 702. The attachment devices can be reversibly detachable, e.g. via snaps, a button and hole type design, a zipper, or a hook, or can be more permanent, e.g. via sewing, welding, adhesive, or so forth. Any other attachment methods for attaching the strip to the hanging product can be used as well. For example, tabs such as tabs 175 in FIGS. 8 and 9 can be affixed to the bottom of strip 706 to attach the strip to a product. In one embodiment, an existing hanging product with holes can easily be converted to one of the present invention by attaching the strip 706 to the hanging product using the holes. As with the other hanging products of the present invention, the hanging product 702 can be woven, non-woven, rigid, semi-rigid, or so forth.

Figure 31:
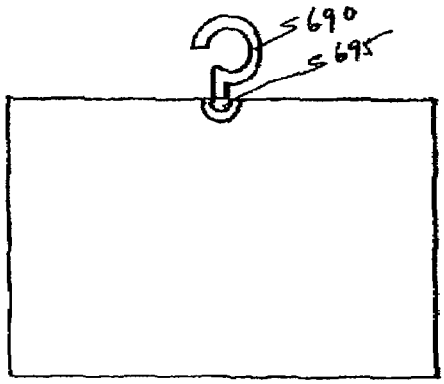
FIG. 31 is an accessory holder for holding spoons, forks, spatulas, and so forth in accordance with the invention.
Figure 30A:
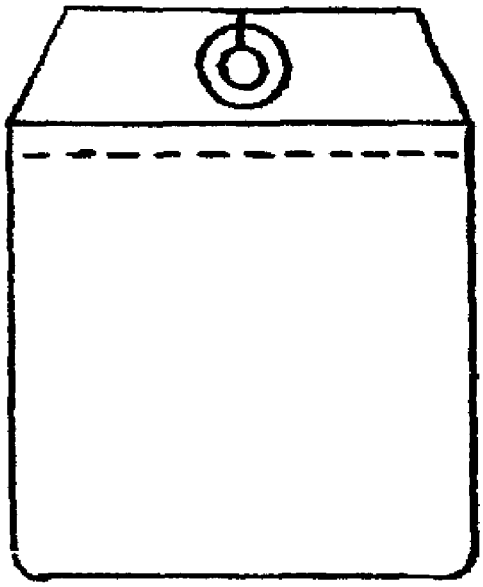
FIG. 30(*a*) is a potholder and FIG. 30(*b*) is an oven mitt in accordance with the invention.
Figure 30B:
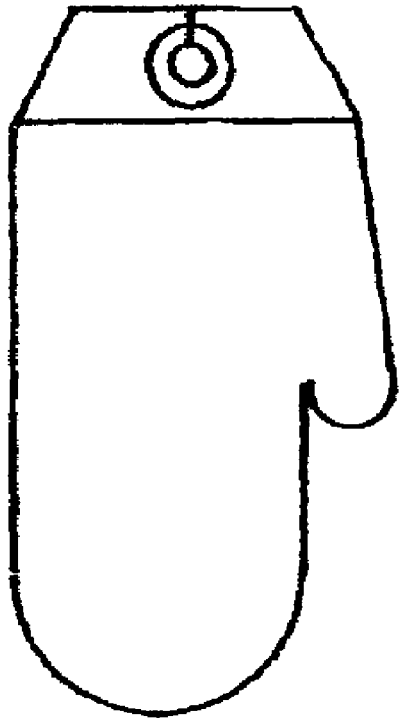
Figure 31:
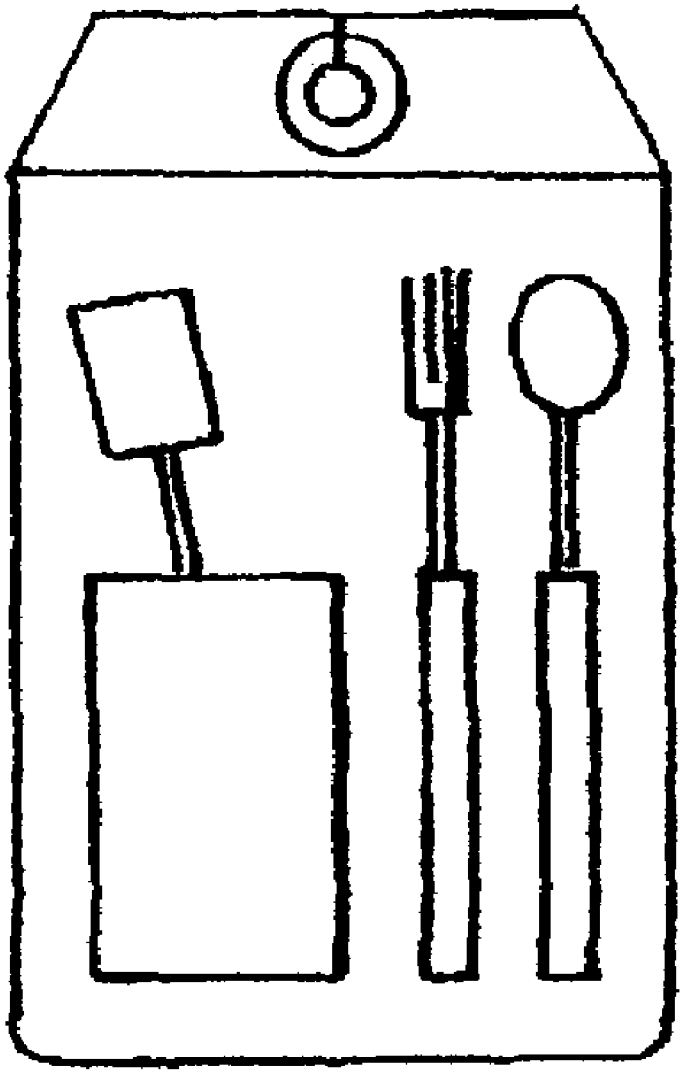

Towel related products can include potholders, as shown in FIG. 30(*a*), oven mitts, as shown in FIG. 30(*b*), and accessory holders, as shown in FIG. 31.

Further in accordance with the invention, the embodiments can be placed in sequence from right to left along a rod. This allows a person to cover a rod with a large number of towels, a larger number than could be placed on a rod by folding the towel over the rod in accordance with the prior art.

As shown in FIG. 25, the slit 344 can include a segment or slit 344*a* which extends through the towel 350, and a segment or slit 344*b* which extends through the ring 340. As previously discussed with respect to FIG. 20, the slit 344 need not be in a straight line. As shown in FIG. 25, slit 344*a* is at an angle to slit 344*b*, the angle being other than 180 degrees. If desired, the slits 344*a* and 344*b* can combine to form a curved slit, or can be two straight segments at any angle to each other, the latter being shown in FIG. 25.

As shown in FIG. 26, in a further preferred embodiment the towel includes an inner cut-out area 380 and is reinforced with a rigid or semi rigid backing in this area. The towel or hanging product includes a slit 370 which extends from the edge of the hanging product to the inner cut-out area 380. Slit 370 includes a left radial edge 375*a* and a right radial edge 375*b*. Preferably, the slit is an offset slit. Further preferably, the radius of the left radial edge 375*a* is different than the radius of the right radial edge 375*b*. FIG. 26(*a*) can therefore be contrasted with FIG. 17 which shows an embodiment in which the left and right radial edges 388*a* and 388*b* are of equal radii, and wherein the slit is not offset but central, along the radius of the circle. In the embodiment of FIG. 26(*a*) it is also preferred that the left radial edge and right radial edge contact each other, although a gap can alternately be provided.

A towel can also have a ring designed in this fashion, as shown in FIG. 27. Ring 400 is provided as part of towel or hanging product 401. Ring 400 includes a slit 412. Slit 412 (and likewise ring 400) has a left radial edge 402*a* and a right radial edge 402*b*, wherein left radial edge 402*a* and right radial edge 402*b* have different radii. The ring 400 includes an edge 404 which is flat along at least a portion of the upper edge of the ring and preferably overlaps hem 406. Extension 408 off of the ring 400 further serves to make it easier to open the ring and facilitates its attachment onto a rod, and also serves to support the hem 406.

Further in accordance with the invention, any of the embodiments herein can be used to hang the product with the fastener off of a rod or a hook. Any embodiment can be hung off of a hook, by providing an open interior 20 to the embodiment. The towel or fastener is then hung over the hook by inserting the open interior 20 (such as a hole) over an end of the hook. Thus the product can suspended from a rod by opening up and closing the slit, or can be suspended off of a hook by inserting the hook through the open interior.

Figure 32:
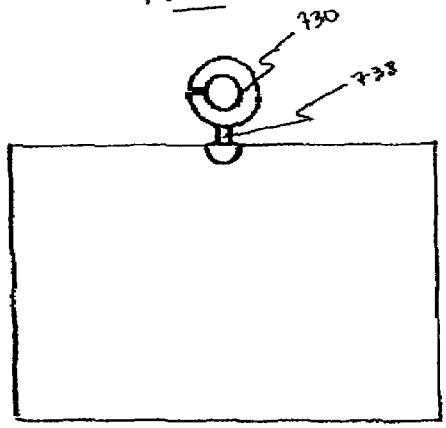
FIG. 32 is a front view of a rotating fastener in accordance with the invention.

In a further embodiment of the invention, a rotating fastener or ring is utilized for placement of the product on a rod, without removing the rod from its supports, as shown in FIGS. 32-25. Ring 730 is mounted on a pivoting member 738, as shown in FIG. 32. This pivoting member allows the ring to rotate so that the towel can be suspended at the desired angle with the shower rod. Alternatively, the ring 740 can be fastened onto to the towel at fixed angle.

Figure 33:
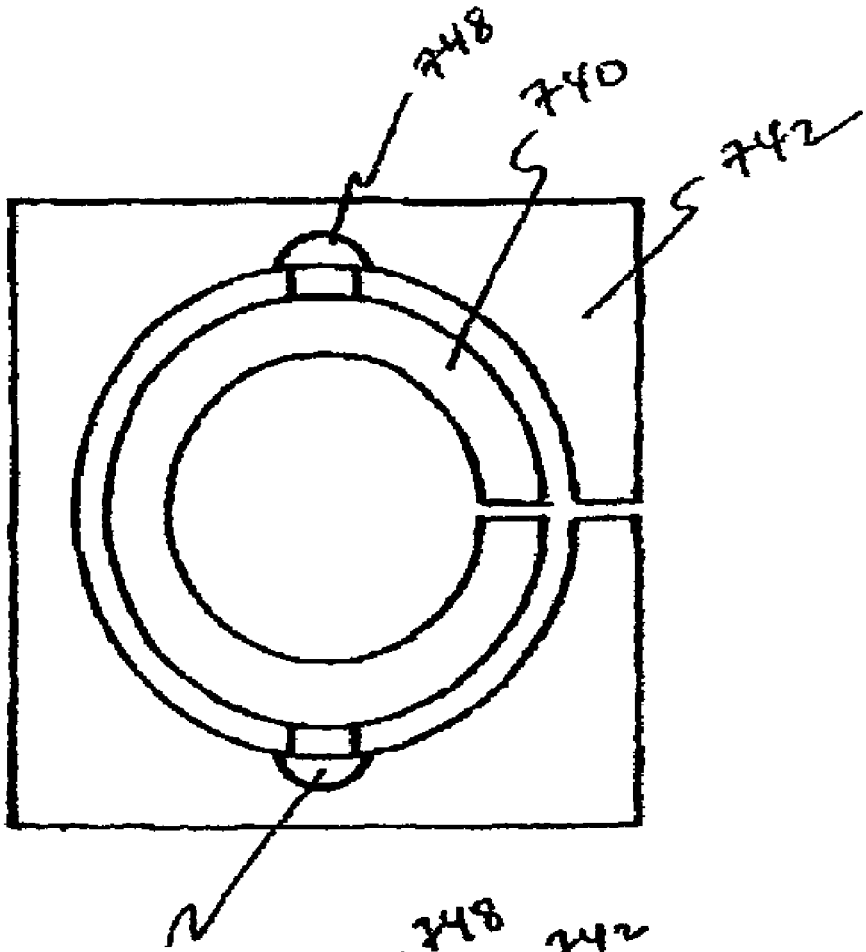
FIG. 33 is a front view of a further embodiment of a rotating fastener in accordance with the invention, the rotating fastener being in a first configuration.
Figure 34:
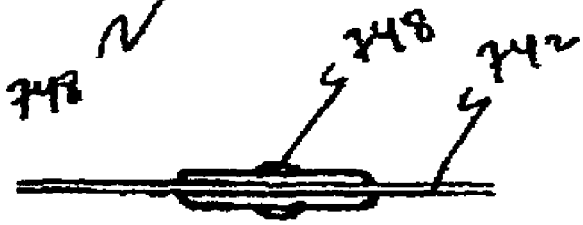
FIG. 34 is a top view of the rotating fastener of FIG. 33 in a first configuration.
Figure 35:
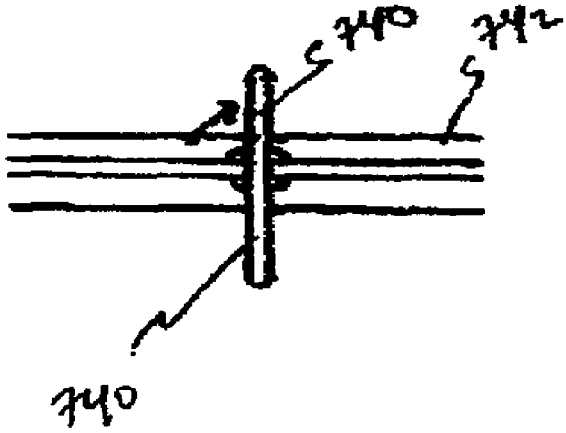
FIG. 35 is a top view of the rotating fastener of FIG. 33 in a second configuration after rotation.

A further embodiment of the rotating ring is shown in FIG. 33. Preferably, the ring 740 is mounted in an outer frame 742, with the pivots 748 extending from that frame to the ring 740. In the initial position, the ring is flat in the frame 742 (with the frame 742 being flush with the product) as shown in FIG. 34. The ring can rotate on the pivots 748 to a position where it is perpendicular with the frame 742 and the surface of the product as shown in FIG. 35. This embodiment allows the position towel to be rotated while it is hanging on the rod, to ease drying of the hands.

In a further embodiment, a hook can be directly attached to the product, whether a rotating hook or a fixed hook. In a first series of embodiments of the present invention, a hook is provided to the towel for affixing it to the rod. This hook can be permanently attached to the product or can be removable. If desired, the hook can rotate from a lower position overlapping the product (the position the hook is kept in when it is not being used to hang the product), to an upper position wherein the hook extends from the product in a configuration which allows the product to hang from a bar.

Figure 36:
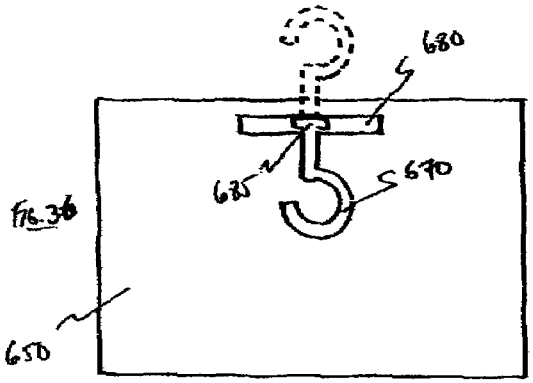
FIG. 36 is a front view of a product having a rotating hook in accordance with the invention.

For example, a hook 670 can be provided to the product as shown in FIGS. 36 and 37. If desired, the hook can rotate into and out of the plane of the product as shown in FIG. 36. The hook is located in a pocket 680, which has an opening 685, allowing the hook to rotate upward and downward. Alternatively, the hook 690 can be attached to a pivot 695 as shown in FIG. 37, allowing the hook to rotate clockwise (or counterclockwise) in the plane of the product.

In an additional embodiment of the invention, an adapter 600 is provided as shown in FIG. 28. This adapter attaches over a item such as a door, drawer, or so forth by inserting the extension 610 over an upper edge of that door or drawer. For those items which, unlike a door or drawer, do not have a top flange, the adapter can be provided without the extension 610, and can be attached to the item by screwing, gluing, nailing or so forth. Or, the adapter can be attached to a peg board if there are mating rods extending from the adapter.

Adapter 600 includes a rod or bar 620. In this manner, any door or drawer can be quickly adapted to provide a rod or series of hooks thereon for suspending the towels of the present invention. As an alternative to a rod or bar, one or more hooks can be provided.

Although the present inventions have been described in many of the embodiments using towels as an illustration, it is to be understood that they may be used with any towel-related products or any of the products of the related applications listed above, the contents of which are incorporated herein by reference. Likewise, although they have been described with reference to hanging the products on a rod, it will be apparent that they can also be used to hang the products on hooks, handles, and so forth.

Having described this invention with regard to specific embodiments, it is to be understood that the description is not meant as a limitation since further modifications and variations may be apparent or may suggest themselves. It is intended that the present application cover all such modifications and variations.

What is claimed is:

1. An article of manufacture, comprising:

an article for holding a pot, said article comprising a ring, said ring being affixed to said article, said ring comprising an opening and a slit, said slit comprising a first width, wherein said ring has sufficient flexibility to allow a user to enlarge said first width of said slit to a greater width when force is applied by the user, wherein said ring has memory such that, after said ring is flexed, said slit will return to said first width when the force is removed; and, wherein said article comprises an edge and wherein said slit intersects with said edge and said opening.

2. An article as claimed in claim 1, wherein said edge is an upper edge of said article.

3. An article as claimed in claim 1, wherein said ring allows suspension of said article from a rod, without removing the rod from its supports.

4. An article as claimed in claim 1, wherein said article is an oven mitt.

5. An article as claimed in claim 1, wherein said article is a potholder.

6. An article as claimed in claim 1, wherein said ring allows suspension of said article from a mounted support.

7. An article of manufacture, comprising:

a towel-related product, said towel-related product comprising a ring, said ring being affixed to said towel-related product, said ring comprising an opening and a slit, said slit comprising a first width, wherein said ring has sufficient flexibility to allow said slit to be enlarged from said first width of said slit to a greater width when force is applied by the user, and wherein said ring has memory such that, after said ring is flexed, said slit will return to said first width when the force is removed; and wherein said article comprises an edge, and wherein said slit intersects with said edge and said opening.

8. An article as claimed in claim 7, wherein said edge is an upper edge of said article.

9. An article as claimed in claim 7, wherein said ring allows suspension of said article from a rod, without removing the rod from its supports.

10. An article as claimed in claim 7, wherein said ring allows suspension of said article from a mounted support.

11. An article as claimed in claim 7, wherein said towel-related product is a utensil holder.

12. An article as claimed in claim 7, wherein said towel-related product is a sponge.

13. An article as claimed in claim 7, wherein said towel-related product is an accessory holder.

14. An article as claimed in claim 7, wherein said towel-related product is a household product.

15. An article of manufacture, comprising:

a towel, said towel comprising a ring, said ring being affixed to said towel, said ring comprising an opening and a slit, said slit comprising a first width, wherein said ring has sufficient flexibility to allow said slit to be enlarged from said first width of said slit to a greater width when force is applied by the user, and wherein said ring has memory such that, after said ring is flexed, said slit will return to said first width when the force is removed; and wherein said article comprises an edge, and wherein said slit intersects with said edge and said opening.

16. An article as claimed in claim 15, wherein said edge is an upper edge of said article.

17. An article as claimed in claim 15, wherein said ring allows suspension of said article from a rod, without removing the rod from its supports.

18. An article as claimed in claim 15, wherein said ring allows suspension of said article from a mounted support.

* * * * *